US005526728A

United States Patent [19]

Behrenfeld

[11] Patent Number: 5,526,728

[45] Date of Patent: Jun. 18, 1996

[54] SELF-ALIGNING DRUM BEATER

[76] Inventor: Eric J. Behrenfeld, 1737 N. Paulina, Unit 107, Chicago, Ill. 60622

[21] Appl. No.: 375,448

[22] Filed: Jan. 18, 1995

[51] Int. Cl.[6] ..... G10D 13/02

[52] U.S. Cl. ..... 84/422.1

[58] Field of Search ..... 84/422.1, 422.2, 84/422.4

[56] References Cited

U.S. PATENT DOCUMENTS

| | | |
|---|---|---|
| 1,570,167 | 1/1926 | Mortensen . |
| 2,586,163 | 2/1952 | Heiderich et al. . |
| 3,316,792 | 5/1967 | Ippilito . |
| 3,411,395 | 11/1968 | Hanes . |
| 4,640,177 | 2/1987 | Elliott, Jr. . |
| 5,204,485 | 4/1993 | Lombardi . |
| 5,317,946 | 6/1994 | Hoshino . |

OTHER PUBLICATIONS

Up Beat Daily, "Pro–Mark Bass Drum Beater Self–Adjusts", Jan. 23, 1994, p. 24.

Modern Drummer, "Pro–Mark Self–Adjusting Beater", by Rick Van Horn, Nov., 1994, p. 44.

*Primary Examiner*—Cassandra C. Spyrou

*Attorney, Agent, or Firm*—Michael R. McKenna

[57] ABSTRACT

A self-aligning bass drum beater that allows the drummer to play without the need to make any adjustments to the beater. Because it is self-aligning, it remains centered when impacting the bass drum head, producing maximum sound projection.

The beater also has two different contact surfaces 180° apart which may be selectively rotated to create different sounds wren striking the head of a bass drum.

26 Claims, 2 Drawing Sheets

SELF-ALIGNING DRUM BEATER

BACKGROUND OF THE INVENTION

The invention relates to a drum beater device which is typically used with a bass drum and a drum beater foot pedal. The present invention discloses a novel self-aligning beater which allows the head to self-align with a flat striking surface of a bass drum.

The self-aligning beater device comprises a drum beater head having preferably two impact surfaces which may be selectively rotated to expose one of the impact surfaces to the striking surface of a bass drum.

The impact surface of the head free for angular displacement relative to the shaft and for circumferential rotation about the shaft, whereby, the impact surface of the head may independently align itself with the striking surface of a drum by swiveling angularly relative to the shaft and by rotating circumferentially about the shaft as the impact surface of the head engages the flat striking surface of the drum.

Moreover, in the way the impact surface of the head may independently align itself with the striking surface of the drum by swiveling angularly relative to the shaft and by rotating circumferentially about the shaft as the impact surface of the head engages the flat striking surface of the drum.

It uniquely employs a unitary axle independent of moving parts for mounting the head to an upwardly extending shaft while leaving the impact surface of the head free for angular displacement relative to the shaft and for circumferential rotation about the shaft.

The self-aligning drum beater may be used with a bass drum pedal and a flat striking surface of a bass drum.

ADVANTAGES OF THIS INVENTION

The instant invention is an improvement over current bass drum beaters because it allows the drummer to play the bass drum with no adjustment of the beater. Because the instant invention is self-adjusting, it remains centered when impacting the bass drum head, causing maximum sound projection.

How it remains centered is a function of its design. It can rotate circumferentially about the shaft. It also will move angularly relative to the shaft. The best mode contemplated provides the head may angularly displace relative to the shaft up to 15° to accommodate changes in the distance of the beater head from the point where it attaches to the foot pedal relative to the position of the bass drum head (striking surface).

Most current beater heads are fixed, and do not move relative to the shaft without manual adjustment requiring a tool. Once set up in the foot pedal, they are tightened and no adjustment can be made unless they are loosened and repositioned.

These fixed beaters have the tendency not to hit the bass drum squarely unless set-up by the drummer is perfect. Imperfect settings affect sound quality due to poor surface contact.

In addition, during play, the bass drum foot pedal, which the beater is attached to, will sometimes loosen from the bass drum particularly if the pedal was not squarely aligned initially. Under such circumstances, the skewed contact between a fixed beater and the head of the bass drum tends to move the pedal in a lateral direction which eventually becomes unplayable causing the drummer to stop playing and reset the pedal position. This problem is reduced substantially by the present invention.

With the instant invention, this tendency is reduced, even eliminated, because the beater aligns itself to hit square at all times.

The instant invention beater head design described herein has two different contact surfaces, 180 degrees apart. One side has a high impact, maximum surface area shape, the other a minimal tangent line of contact (oval ended side). Because of style changes in music and songs, it makes things easier if the drummer can turn the beater head around quickly for a different bass drum sound, without having to use tools or stopping to reset the beater in the foot pedal, and just keep playing. In other words, with the same foot pedal motion, two different sounds can be made with the instant invention simply by turning the head around 180 degrees.

A preferred material of the head is HYTREL®. This material was chosen for its ability to resist heat (from friction), retain its shape (from impact) and not "color" or change the sound in an undesirable manner. Hard beater heads made of wood or other hard plastics tend to cause a loud sharp "click" when impacting the bass drum head. Beater heads made of compressed felt are very soft sounding and extremely limited to their ability in shaping for manufacture. The HYTREL® combines the best features of these beaters to produce a new unique sound, only available from using the instant invention bass drum beater of the disclosed invention.

A preferred material for the center cap which holds the head, is a glass filled nylon which is used for durability, strength and resistance to stretch, bending, and brittleness which results in breakage. The shaft is made of stainless steel which is superior in resisting permanent bending.

In conclusion, because of the shape, material, and mechanical function of the instant invention beater, it has a new unique sound producing capability never before available to drummers. In addition, it works better with the foot pedal, because it inhibits loosening by remaining square during play. Also, the drummer using the instant invention needs no tools to set it up, other than fastening the shaft into the foot pedal.

The instant drum beater device provides an efficient and convenient means for self-alignment.

Still other advantages will be apparent from the disclosure that follows.

SUMMARY OF THE INVENTION

The invention relates to a drum beater apparatus which is typically used with a bass drum and a drum beater foot pedal. The present invention discloses a novel self-aligning beater which allows the head to self-align with a flat striking surface of a bass drum.

The self-aligning beater apparatus comprises a drum beater head having at least one impact surface and an elongated passageway extending from the bottom thereof to receive a shaft, and a means for mounting the head to an upwardly extending shaft while leaving the impact surface of the head free for angular displacement relative to the shaft and for circumferential rotation about the shaft, whereby, the impact surface of the head may independently align itself with the striking surface of a drum by swiveling angularly relative to the shaft and by rotating circumferentially about the shaft as the impact surface of the head engages the flat striking surface of the drum.

The self-aligning drum beater may be used with a bass drum pedal and a flat striking surface of a bass drum. It uniquely employs a unitary axle independent of moving parts for mounting the head to an upwardly extending shaft while leaving the impact surface of the head free for angular displacement relative to the shaft and for circumferential rotation about the shaft. In the way the impact surface of the head may independently align itself with the striking surface of the drum by swiveling angularly relative to the shaft and by rotating circumferentially about the shaft as the impact surface of the head engages the flat striking surface of the drum.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
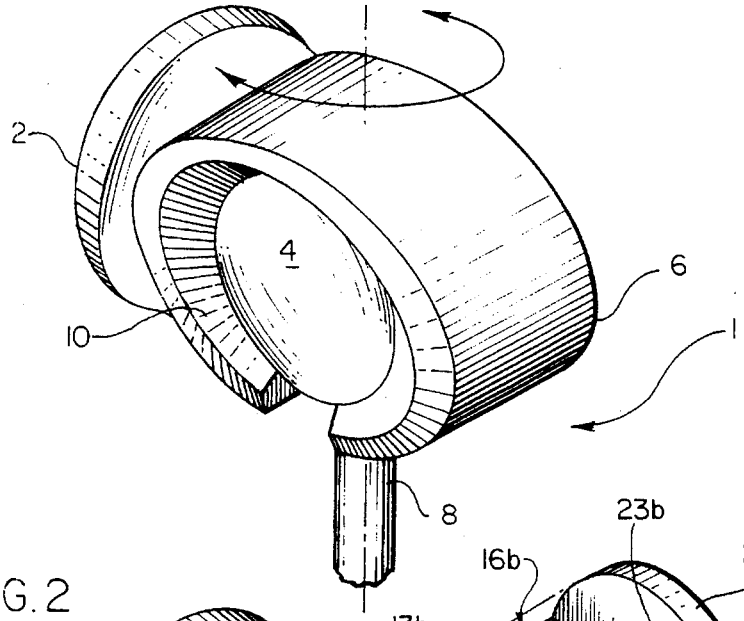
FIG. 1 is a perspective view of a preferred embodiment of the self-aligning beater of the present invention with the head thereof attached to an upstanding shaft.

The preferred embodiments depicted in the drawing include a self-aligning beater which allows the head to self-align with a flat striking surface of a bass drum. The beater depicted has two impact surfaces disposed on opposite sides of the head which can be selectively positioned. Without departing from the generality of the invention disclosed herein, the head should have at least one and could be provided with additional impact surfaces, and with varying ranges of angular displacement relative to the shaft. The discussion that follows, without limiting the scope of the invention, will refer to the invention as depicted in the drawing.

Figure 2:
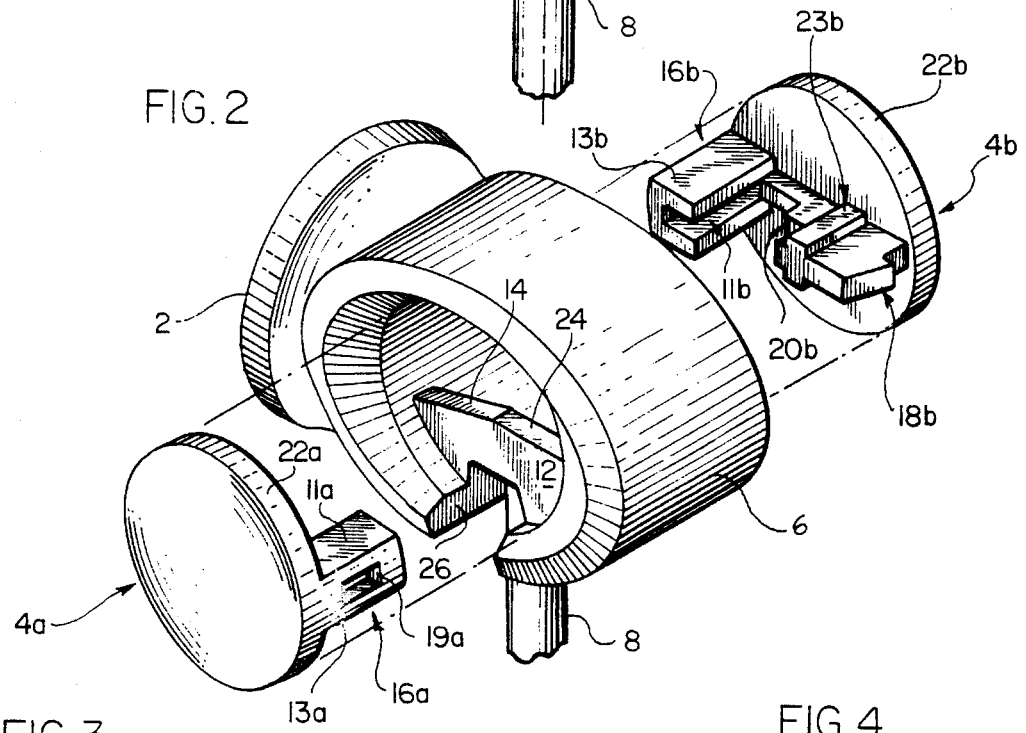
FIG. 2 is an exploded perspective view of the self-aligning beater of FIG. 1 with the caps exploded outwardly to show the interior structure of the head and the snap fastening projection disposed on the interior side of the caps.
Figure 5:
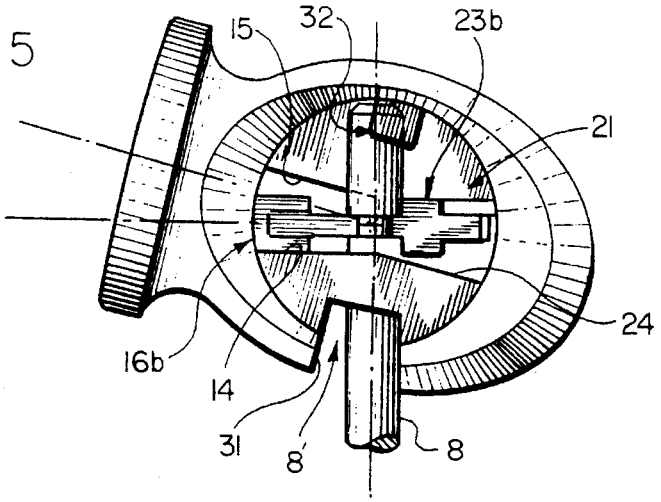
FIG. 5 is a side elevation view of the self-aligning beater of FIG. 4 with the head angularly displaced relative to the shaft.

As best shown in FIG. 2 of the drawing, the present invention provides a self-aligning drum beater adapted for use with a bass drum pedal and a flat striking surface of a bass drum (not shown). The device comprises a drum beater head 1 having at least one impact surface (2, 6) and an elongated passageway 8' extending from the bottom thereof to receive a shaft 8. A means for mounting the head 1 to an upwardly extending shaft 8 is provided that leaves the impact surface of the head 1 free for angular displacement relative to said shaft (as shown in FIG. 5) and for circumferential rotation about said shaft, as illustrated by the arrow in FIG. 1. This embodiment of this important invention allows the impact surface (particularly 2) of the head 1 to independently align itself with the striking surface of a drum by swiveling angularly relative to the shaft and by rotating circumferentially about the shaft as the impact surface of the head engages the flat striking surface of the drum.

In a preferred embodiment, as shown in FIG. 2, the beater head 1 comprises an elongated housing having a generally flat impact surface 2 disposed on one end and an arcuate surface 6 on the other.

The head 1 further has laterally disposed openings 14 on the sides thereof, said openings 14 have a resilient seating area disposed in said housing. The instant device further comprises a pair of identical caps, each of which may be disposed in one of said openings 14.

Referring again to FIG. 2, the self-aligning drum beater comprises a unitary axle independent of moving parts for mounting the head to the upwardly extending shaft. The self-aligning drum beater employs a pair of caps (**4*a*, 4*b*) as a means for mounting the head 1 to the shaft 8**.

Each cap has a disk-like shape with an exterior side and an interior side with an irregularly shaped elongated projection disposed on the interior side thereof. As shown on cap **4*b*, each such projection comprises a snap fastener having a male snap fastening member 18*b* and a female snap fastening member 16*b* disposed on the other end thereof. As shown in FIG. 2, the male snap fastening member 18*b* is arranged and adapted to lockingly engage female snap fastening member 16*a* of cap 4*a*** as the respective caps are joined with the projections in a face to face relationship.

The projection of the cap **4*b*, as shown in FIG. 2, reveals a female snap fastener 16*b* having a channel shaped body 13*b* disposed horizontally with a horizontal recess 11*b* disposed therein which is arranged and adapted to receive a male snap fastener (not shown) of cap 4*a* (identical to 18*b* of cap 4*b*). Said female snap fastener 16*b* has a opening disposed in the channel shaped body 13*b* for receipt of the male snap fastener. This aspect of the invention can be seen on cap 4*a*, wherein the opening 19*a* is disposed in channel shaped body 13*a* for receipt of the male snap fastener 18*b***.

Figure 6:
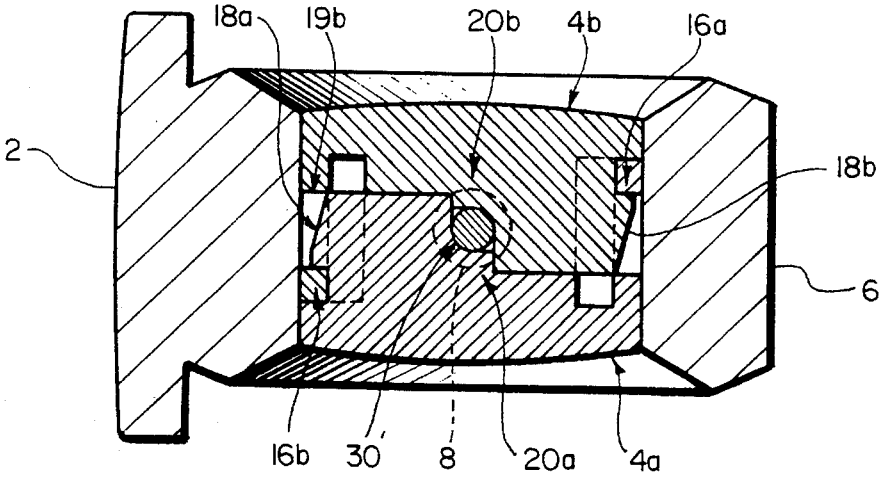
FIG. 6 is a cross-sectional take along the line 6—6 of FIG. 3 showing the snap fastening projection disposed on the interior side of each of the caps in a locking engagement with each other and further showing the orifice thereby created for the circumferential groove of the shaft.

As shown in FIG. 6, each of said caps further comprises a centrally disposed web (**20*a* and 20*b*, respectively). The webs of the respective joined caps are arranged and adapted to form an orifice 30' in which the shaft 8 having laterally grooved section 30 may be rotatingly disposed. Whereby, the joined caps may rotatingly secure the head 1 to the laterally grooved section 30 of the shaft 8**.

Figure 3:
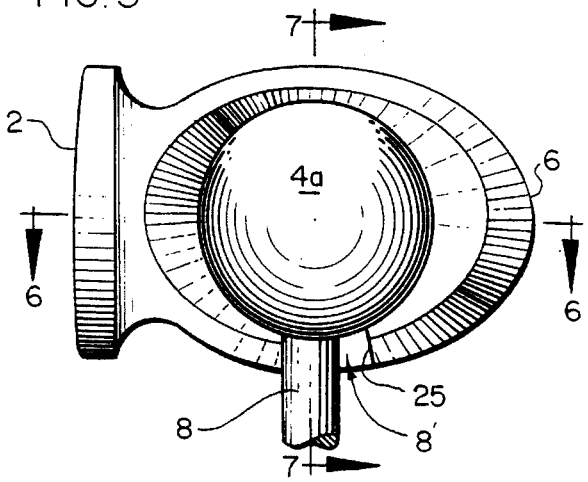
FIG. 3 is a side elevation view of the self-aligning beater of FIG. 1.

As shown in FIG. 3, the beater head 1 is positioned on the upstanding shaft 8 which shaft is extended into the passageway 8' of the head. Since the head is designed to angularly displace relative to the shaft, the passageway 8' of the head 1 has a tapered entrance 24.

Figure 4:
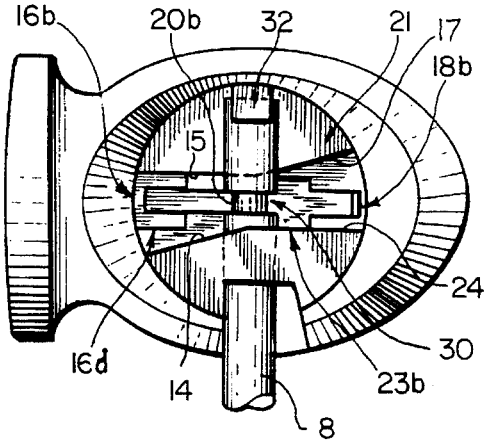
FIG. 4 is a side elevation view of the self-aligning beater of FIG. 1 with the proximate cap removed to show the relationship between the interior structure of the head and the snap fastening projection disposed on the interior side of the distal cap.

FIG. 4 shows the preferred embodiment of the current invention with cap **4*a* removed disclosing the arrangement of the head 1, cap 4*b*, and the shaft 8. On the head is shown that an interior wall 21 with the chamfered edge is disclosed. The interior wall 21 has lower edges 15 and 17. With the head having the angular displacement as shown in FIG. 4., edge 15 engages the top of the female snap fastener 16*b* of cap 4*b*. The web 20*b*** of said cap engages the grooved section 30 of the shaft 8. To the right of the shaft the web 20*b* widens vertically disposing a contact surface 23*b* which abuts chamfered edge 24 of interior wall 12. Additionally, a downwardly projecting nub 32 of the head is positioned laterally to engage both cap 4*a* and shaft 8. This aspect can be more clearly viewed in FIG. 7.

FIG. 5 is like FIG. 4, with only with the head 1 angularly displaced maximally relative to shaft 8, such that the edge 14 of interior wall 12 is now in contact with the female snap fastener 16*b* of cap 4*b* and the vertically extended section of the web 23*b* is in contact with edge 17 of interior wall 21. Moreover, if the tapered angle of the passageway 8' is equal to the chamfered angle of the edges of the respective interior walls (12 and 21, respectively) then the shaft 8 will be in contact with surface 25 of the passageway 8' of the head 1.

Figure 7:
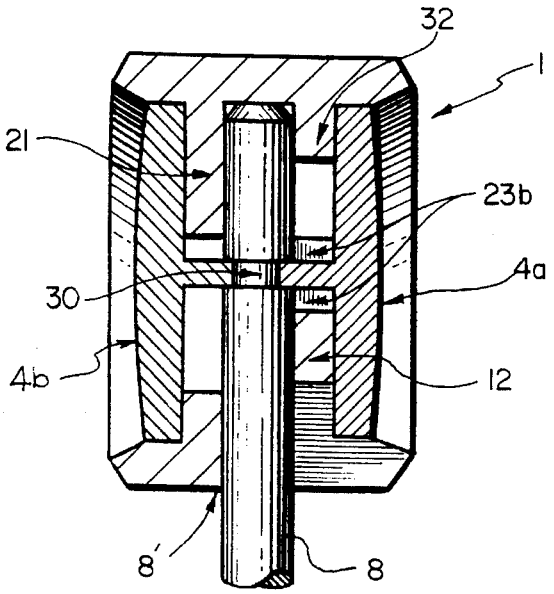
FIG. 7 is a cross-sectional take along the line 7—7 of FIG. 3. showing the snap fastening projection disposed on the interior side of each of the caps in a locking engagement with each other and further showing some of the frictional contact surfaces disposed internally in the present invention.

As best shown in FIG. 7, the means for mounting further provides frictional engagement with the head to dampen angular movement of the head relative to the shaft. Such frictional engagement exist between wall 21 and the cap 4*b* and the shaft 8, and between wall 12 and the shaft 8 and the cap 4*a*. Additionally, each cap's peripheral edge (22*a* and 22*b*, respectively) frictionally engages the head. The frictional resistance allows the head to angularly displace in an infinite number of positions between the physical limits referenced herein.

Moreover, frictional engagement between the respective webs (20*a* and 20*b*) of the caps and the circumferential groove 30 of the shaft 8 to dampen circumferential rotation of the head about said shaft is provided, as best shown in FIGS. 4, 5, 6, and 7.

In a preferred embodiment, the means for mounting provides a first frictional engagement with the head to dampen angular movement of the head relative to the shaft and a second frictional engagement with the head to dampen circumferential rotation about said shaft.

The circumferential groove 30 is disposed proximate to the end disposed in the passageway 8' of the head 1. For shafts that are not cylindrical a lateral groove having a circular cross-section may be employed.

In the embodiments disclosed, the means for mounting the head to the shaft is movable relative to said shaft. Moreover, it is also movable relative to said head. Furthermore, in the preferred embodiments disclosed, the means for mounting the head to the shaft is movable relative to the shaft and to the head.

As shown in FIG. 2, the means for mounting comprises a pair of identical caps (4*a* and 4*b*). Each cap has a disk-like shape having an exterior side and an interior side and a irregularly shaped elongated projection disposed on the interior side thereof. The projection comprises a snap fastener having a male snap fastening member (18*a* and 18*b*, respectively, see FIG. 6) disposed on one end and a female snap fastening member (16*a* and 16*b*, respectively) disposed on the other end. Each male snap fastening member is arranged and adapted to lockingly engage the female snap fastening member disposed on the other cap as the respective caps are joined with the projections in a face to face relationship with one of the caps rotated 180° from a mirror image of the other cap.

Each of the caps further comprises a web (20*a* and 20*b*) disposed between its male and female snap fastening members. The webs of the respective joined caps are arranged and adapted to form an orifice in which a lateral groove of the shaft may be rotatingly disposed. In this way, the caps may rotatingly secure the head to a lateral grooved shaft.

The self-aligning drum beater of the present invention further comprises a means for limiting the angular displacement of the head relative to the shaft. This comprises at least one partial vertical wall (12 and 21, respectively) disposed internally with a chamfered exposed edge (14 and 24, respectively for wall 12, and 15 and 17, respectively for wall 21). The respective edges are arranged and adapted to limit the angular displacement of the head relative to the shaft as it engages the respective projections of the joined caps. See FIGS. 4 and 5, respectively. In another embodiment, the edges of the disk-like section of the cap may be beveled.

The head 1 further comprises an outwardly tapering passageway 8' to allow the head to angularly displace relative to the shaft free from binding the shaft. See tapered wall 24 of FIG. 3.

In a preferred embodiment, as shown in all of the figures of the drawing, the head 1 of the self-aligning drum beater comprises two impact surfaces (2 and 6, respectively) disposed on opposite sides thereof.

In a preferred embodiment, at least one of the impact surfaces is generally disk-like with a slight convex aspect 2 and at least one of the impact surfaces is an arcuate surface 6 comprised of a plurality of parallel lines, each of said parallel lines being perpendicular to the axis of the passageway of said head. As shown in FIG. 1, a first impact surface 2 is generally disk-like with a slight convex aspect and a second impact surface is an arcuate surface 6 comprised of a plurality of parallel lines, each of said parallel lines being perpendicular to the axis of the passageway of said head.

Although not shown in the drawing, a preferred embodiment of the instant invention reveals a means for breaking vacuum between the impact surface of the head and the striking surface of the bass drum. Such means for breaking vacuum may comprise a surface recess disposed on at least one peripheral edge of the impact surface and many other commonly known methods.

Although frictionally resisted, the head 1 may be manually rotatable circumferentially about an upstanding shaft 8, whereby each of the impact surfaces may be selectively disposed proximate to the striking surface of a bass drum.

The instant invention may further comprise a shaft 8 having a lateral groove 30 disposed proximate to an end which may be disposed in the passageway of the head 1.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

Further, the purpose of the foregoing specification is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application. The foregoing is neither intended to define the invention of the application, which is measured by the claims, nor is it intended to be limiting as to the scope of the invention in any way.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A self-aligning drum beater adapted for use with a flat striking surface of a bass drum comprising:

a. a drum beater head having a bottom and at least one side surface with at least one impact surface disposed on the side surface and an elongated passageway extending from the bottom thereof to receive a shaft; and b. a means for mounting the head to an upwardly extending shaft while leaving the impact surface of the head free for angular displacement relative to said shaft and for circumferential rotation about said shaft, whereby, the impact surface of the head may independently self-align with the striking surface of the bass drum by swiveling angularly relative to the shaft and by rotating circumferentially about the shaft as the impact surface of the head engages the flat striking surface of the bass drum.

2. The self-aligning drum beater of claim 1, wherein the means for mounting further provides frictional engagement with the head to dampen angular movement of the head relative to the shaft.

3. The self-aligning drum beater of claim 1, wherein the means for mounting further provides frictional engagement with the head to dampen circumferential rotation of the head about said shaft.

4. The self-aligning drum beater of claim 1, wherein the means for mounting further provides a first frictional engagement with the head to dampen angular movement of the head relative to the shaft and a second frictional engagement with the head to dampen circumferential rotation about said shaft.

5. The self-aligning drum beater of claim 1, wherein the upwardly extending shaft has a lateral groove disposed proximate to an end thereof disposed in the passageway of the head.

6. The self-aligning drum beater of claim 1, wherein the means for mounting the head to the shaft is movable relative to said shaft.

7. The self-aligning drum beater of claim 1, wherein the means for mounting the head to the shaft is movable relative to said head.

8. The self-aligning drum beater of claim 1, wherein the means for mounting the head to the shaft is movable relative to the shaft and to the head.

9. The self-aligning drum beater of claim 1, wherein the means for mounting comprises snap fasteners to engage the head on to a shaft.

10. The self-aligning drum beater of claim 1, wherein the means for mounting comprises a first cap and a second cap, each said cap having a disk-like shape with an exterior side and an interior side and an irregularly shaped elongated projection disposed on the interior side thereof, said projection comprising a snap fastener having a male snap fastening member disposed on the first cap and a female snap fastening member disposed on the second cap, the male snap fastening member arranged and adapted to lockingly engage the female snap fastening member as the first cap and the second cap are joined with the projections in a face to face relationship, each of said caps further comprises a centrally disposed web, and the webs of the first cap and the second cap that are joined with the projections in a face to face relationship are arranged and adapted to form an orifice in which a lateral groove of the shaft may be rotatingly disposed, whereby, said caps may rotatingly secure the head to a laterally grooved shaft.

11. The self-aligning drum beater of claim 10, further comprising a shaft having a lateral groove disposed proximate to an end thereof.

12. The self-aligning drum beater of claim 1, wherein the means for mounting comprises a first cap and a second cap that is identical to the first cap, each said cap having a disk-like shape with an exterior side and an interior side and a irregularly shaped elongated projection disposed on the interior side thereof, said projection comprising a snap fastener having a male snap fastening member disposed on a proximal end and a female snap fastening member disposed on a distal end, the male snap fastening member of the first cap arranged and adapted to lockingly engage the female snap fastening member of the second cap as the caps are joined with the projections in a face to face relationship with the first cap rotated 180° from a mirror image of the second cap, each of said caps further comprises a web disposed between the male snap fastener member and female snap fastening member, and the webs of the caps that are joined with the projections in a face to face relationship with the first cap rotated 180° from a mirror image of the second cap are arranged and adapted to form an orifice in which a lateral groove of the shaft may be rotatingly disposed, whereby, said caps may rotatingly secure the head to a lateral grooved shaft.

13. The self-aligning drum beater of claim 12, further comprising a shaft having a lateral groove disposed proximate to an end thereof.

14. The self-aligning drum beater of claim 10, wherein the head further comprises a means for limiting the angular displacement of the head relative to the shaft.

15. The self-aligning drum beater of claim 14, wherein the means for limiting the angular displacement of the head relative to the shaft comprises at least one partial vertical wall disposed internally with a chamfered exposed edge arranged and adapted to limit the angular displacement of the head relative to the shaft as the chamfered exposed edge engages the projections of the first cap and the second cap that are joined with the projections in a face to face relationship, said head further comprises an outwardly tapering passageway to allow the head to angularly displace relative to the shaft free from binding the shaft.

16. The self-aligning drum beater of claim 15, wherein each of said vertical walls frictionally engages a shaft disposed in said head.

17. The self-aligning drum beater of claim 1, wherein the impact surface of the head comprises a means for breaking vacuum.

18. The self-aligning drum beater of claim 17, wherein the means for breaking vacuum comprises a surface recess disposed on at least one peripheral edge of the impact surface.

19. The self-aligning drum beater of claim 1, wherein the head comprises two impact surfaces disposed on opposite sides thereof.

20. The self-aligning drum beater of claim 19, wherein a first impact surface is generally disk-like with a slight convex aspect and a second impact surface is an arcuate surface comprised of a plurality of parallel lines, each of said parallel lines being perpendicular to the axis of the passageway of said head.

21. The self-aligning drum beater of claim 1, wherein at least one of the impact surfaces is generally disk-like with a slight convex aspect.

22. The self-aligning drum beater of claim 1, wherein at least one of the impact surfaces is an arcuate surface comprised of a plurality of parallel lines, each of said parallel lines being perpendicular to the axis of the passageway of said head.

23. The self-aligning drum beater of claim 1, wherein the head is manually rotatable circumferentially about an upstanding shaft, whereby each of the impact surfaces may be selectively disposed proximate to the striking surface of a bass drum.

24. A self-aligning drum beater adapted for use with a flat striking surface of a bass drum comprising:

a. a drum beater head having a bottom and at least one side surface with at least one impact surface disposed on the side surface and an elongated passageway extending from the bottom thereof to receive a shaft; and b. a means for mounting the head to an upwardly extending shaft while leaving the impact surface of the head free for angular displacement relative to said shaft and for circumferential rotation about said shaft consisting of a unitary axle independent of moving parts; and whereby, the impact surface of the head may independently self-align with the striking surface of the drum by swiveling angularly relative to the shaft and by rotating circumferentially about the shaft as impact surface of the head engages the flat striking surface of the drum.

25. A self-aligning drum beater adapted for use with a flat striking surface of a bass drum comprising:

a. a drum beater head having a bottom and at least one side surface with at least one impact surface disposed on the side surface and an elongated passageway extending from the bottom thereof to receive a shaft;

b. a shaft having a lateral groove disposed proximate to an end which may be disposed in the passageway of the head; and c. a means for mounting the head to an upwardly extending shaft while leaving the impact surface of the head free for angular displacement relative to said shaft and for circumferential rotation about said shaft, said means for mounting the head to the shaft is movable relative to the shaft and to the head, said means for mounting comprising a first frictional engagement with the head to dampen angular movement of the head relative to the shaft, a second frictional engagement with the head to dampen circumferential rotation about said shaft, and a first cap and a second cap that is identical to the first cap, each said cap having a disk-like shape with an exterior side and an interior side and a irregularly shaped elongated projection disposed on the interior side thereof, said projection comprising a snap fastener having a male snap fastening member disposed on a proximal end and a female snap fastening member disposed on distal end, the male snap fastening member of the first cap arranged and adapted to lockingly engage the female snap fastening member of the second cap as the first cap and the second cap are joined with the projections in a face to face relationship with one of said caps rotated 180° from a mirror image of the other cap, each of said caps further comprises a web disposed between the male snap fastener member and the female snap fastening member, and the webs of the first cap and the second cap that are joined with the projections in a face to face relationship are arranged and adapted to form an orifice in which the lateral groove of the shaft may be rotatingly disposed, whereby, the impact surface of the head may independently self-align with the striking surface of the bass drum by swiveling angularly relative to the shaft and by rotating circumferentially about the shaft as the impact surface of the head engages the flat striking surface of the drum.

26. The self-aligning drum beater of claim 25, wherein the head further comprises:

a. a first impact surface that is generally disk-like with a slight convex aspect and a second impact surface is an arcuate surface comprised of a plurality of parallel lines, each of said parallel lines being perpendicular to the axis of the passageway of said head, said head being manually rotatable circumferentially about the upstanding shaft, whereby each of the impact surfaces may be selectively disposed proximate to the striking surface of a bass drum;

b. a means for limiting the angular displacement of the head relative to the shaft, said means for limiting the angular displacement of the head relative to the shaft comprises at least one partial vertical wall disposed internally with a chamfered exposed edge arranged and adapted to limit the angular displacement of the head relative to the shaft as the chamfered exposed edge engages the projections of the first cap and the second cap that are joined with the projections in a face to face relationship; and c. an outwardly tapering passageway to allow the head to angularly displace relative to the shaft free from binding the shaft.

* * * * *